US006734642B1

(12) United States Patent
Reverberi

(10) Patent No.: US 6,734,642 B1
(45) Date of Patent: May 11, 2004

(54) MONITORING AND MANAGEMENT SYSTEM FOR LIGHTING NETWORKS

(76) Inventor: Giorgio Reverberi, 5, Via Pavoni, Castelnuovo Ne' Monti Reggio Emilia (IT), 42035

( * ) Notice: Subject to any disclaimer, the term of this patent is extended or adjusted under 35 U.S.C. 154(b) by 0 days.

(21) Appl. No.: 10/367,752

(22) Filed: Feb. 19, 2003

(30) Foreign Application Priority Data

Feb. 22, 2002 (IT) ..... RE2002A0014

(51) Int. Cl.[7] ..... H05B 37/00

(52) U.S. Cl. ..... 315/312; 315/317; 315/362; 315/308

(58) Field of Search ..... 315/151, 158, 315/159, 292, 308, 316, 362, 312, 317, 325, 360; 340/641, 642, 635, 458, 524, 525, 825.11

(56) References Cited

U.S. PATENT DOCUMENTS 4,939,505 A * 7/1990 Cappellini et al. ..... 340/642
5,095,502 A * 3/1992 Finzel ..... 379/40
5,471,201 A * 11/1995 Cerami et al. ..... 340/641

* cited by examiner

*Primary Examiner*—Haissa Philogene
(74) *Attorney, Agent, or Firm*—Browdy and Neimark, P.L.L.C.

(57) ABSTRACT

Monitoring and management system for the lamps of a lighting network comprising a device ($\mathbf{1}_i$), associated with each lamp ($\mathbf{2}_i$) of the network, provided with means (8, 19) for measuring the characteristic operating parameters of the lamp, at least one microprocessor (6, 20) for processing said measured parameters, and a transmitter/receiver for transmitting said data which are received by a central unit (100); said transmitter/receiver is of radio wave type and is arranged to receive the parameters measured by the successive devices ($\mathbf{1}_{i+1,n}$) and to transmit them, together with the parameters measured for the lamp ($\mathbf{2}_i$) with which it is associated, to at least the transmitter/receiver of that device ($\mathbf{1}_{i-1}$) associated with the preceding lamp ($\mathbf{2}_{i-1}$).

11 Claims, 4 Drawing Sheets

MONITORING AND MANAGEMENT SYSTEM FOR LIGHTING NETWORKS

FIELD OF THE INVENTION

This invention relates to monitoring and management systems for lighting networks, such as public electric lighting networks.

BACKGROUND OF THE INVENTION

Electric lighting networks and comparable installations are characterised by very wide-ranging and branched electricity distribution providing energy to each individual lamp.

It is therefore very important to be able to monitor both the state of each individual lamp, and the state of the entire network, in order to be able to program maintenance and prevent local faults or abnormalities.

Management and monitoring systems of known type are arranged to locally collect the significant operating data of the lamp at each lighting point, and to feed them via a carrier wave system to a monitoring operations centre, where the measured data are analysed, as a result of which the interventions to be carried out are programmed.

However, data transmission by means of carrier waves requires the installation, in proximity to each lighting point, of signal filtering elements to filter disturbances to the signal transmitted to the central monitoring unit.

The installation of said filters increases the cost of the network and results in difficulties in filter setting, which must be very accurate to prevent distortion of the signal to be transmitted.

SUMMARY OF THE INVENTION

The object of the invention is to overcome the drawbacks of the known art within the framework of a simple and rational solution. The invention attains said object by virtue of a monitoring and management system comprising, installed in proximity to each lighting point of the network, a device provided with means for measuring the characteristic operating parameters of each lamp, a microprocessor for processing said parameters, and means for receiving and transmitting the measured parameters, said latter means being of radio wave type and being arranged to receive the data relative to the operating parameters of the lamps which follow that with which they are associated, and to transmit said data together with those measured for the lamp with which they are associated, to at least the device associated with the lamp which precedes that with which they are associated.

According to the invention said device can be powered using the electrical line powering the lamp, or using a self-contained power system. Said self-contained power system can comprise a solar panel (photovoltaic cell), positioned in such a manner as to intercept at least a portion of the luminous flux emitted by the lamp, so as to power both the microprocessor and said transmitter/receiver device. Alternatively said components can be powered by a usual storage battery, which is maintained charged by said photovoltaic cell. In this latter case it is obviously not necessary to position said voltaic cell such as to intercept at least a portion of the luminous flux emitted by the lamp, as the battery can be recharged during the day directly by sunlight.

Finally in an advantageous and simplified variant of the invention said means for measuring the parameters characteristic of the lamp operation are able to sense only the light-producing or extinguished state of the lamp and the degree of efficiency of its lighting body. According to this variant said means are the photovoltaic cell which powers the components of the device itself. In this manner the device can be easily and rapidly installed without having to intervene in any way on the electrical system powering the lamp.

Finally, in a further variant of the invention, with each lamp there is associated a usual position satellite receiver, for example of the type known as GPS (GLOBAL POSITION SYSTEM), which receives its coordinates from a satellite position transmitter and transmits them together with the other measured characteristics to an operational control centre. In this manner the operator, in the operational control centre, can display on a monitor the exact position of the lamp with reference to a map of the area in which the lighting network is installed.

DETAILED DESCRIPTION OF THE PREFERRED EMBODIMENTS

Figure 1:
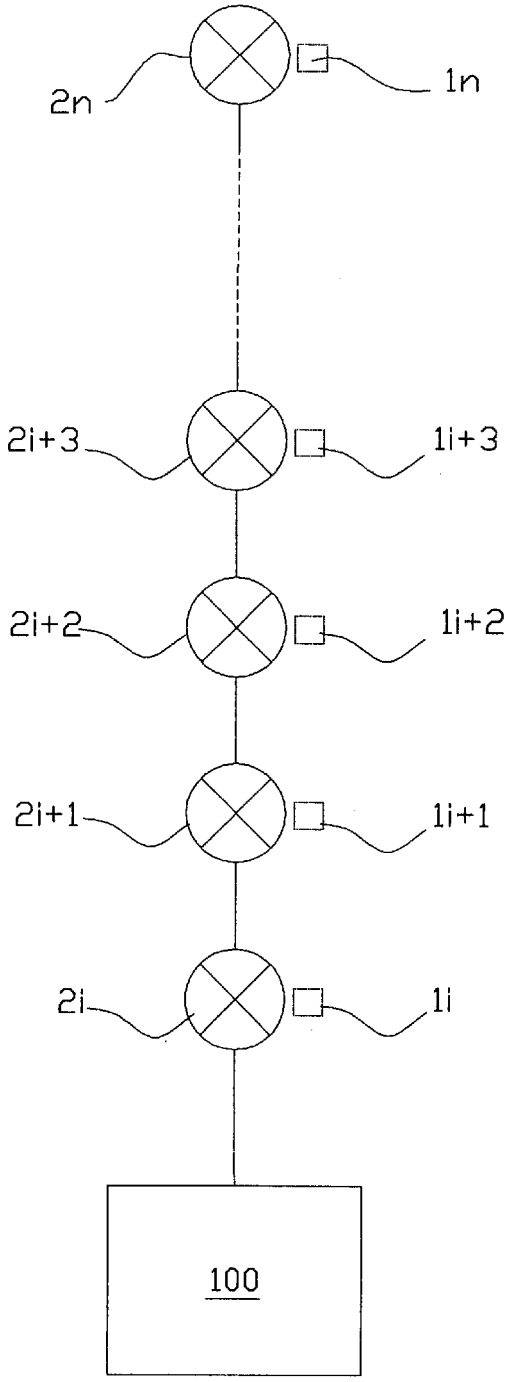
FIG. 1 is a schematic view of the system according to the invention.
Figure 2:
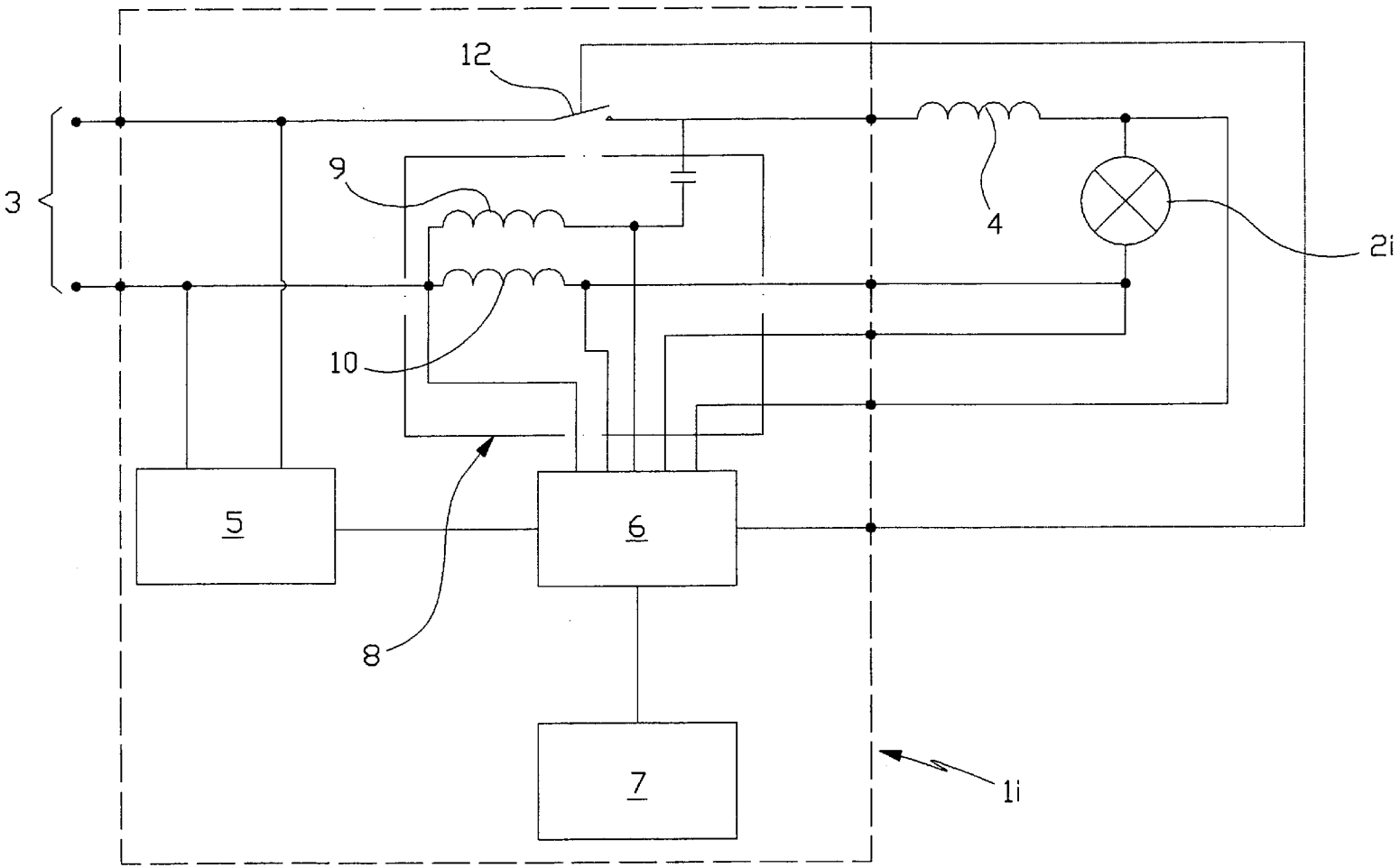
FIG. 2 is a block diagram showing one of the component devices of the system of the invention.

FIGS. 1 and 2 show a plurality of devices $\mathbf{1}_i$ each of which is associated with a lamp $\mathbf{2}_i$, where i varies between 1 and n, n being the number of lamps of the lighting network which is to be kept monitored.

With reference to FIG. 2 each device $\mathbf{1}_i$ is connected in series with the lamp $\mathbf{2}_i$ which is powered by the power supply line via a reactor 4.

The lamp $\mathbf{2}_i$ can be of any type, for example of the mercury vapour or sodium vapour type, and in this latter case is associated with a suitable ignition circuit, not shown in the figure as it is known to the expert of the art.

Each device 1 comprises a power unit 5 connected to the power supply line 3 for the purpose of powering a microprocessor 6, and means 7, of radio wave type, for receiving and transmitting the measured parameters, connected to the microprocessor 6.

The means 8 for measuring the characteristic operating parameters of the lamp 2 are also electrically connected to the microprocessor 6. Said means comprise in particular two devices (or units) 9 and 10 for measuring the line voltage, the lamp voltage, the current and the power factor.

The device 1 also comprises a relay 12 controlled by the microprocessor which switches the lamp on or off.

The receiver/transmitter 7 is able to transmit the data relative to the characteristic operating parameters of the lamp 2, which are measured by said means 8, to the transmitter/receiver of the device $\mathbf{1}_{i-1}$ together with the data of the devices $\mathbf{1}_{i+1,n}$.

The data are then transmitted and received in succession by each device as far as a monitoring centre 100.

Figure 3:
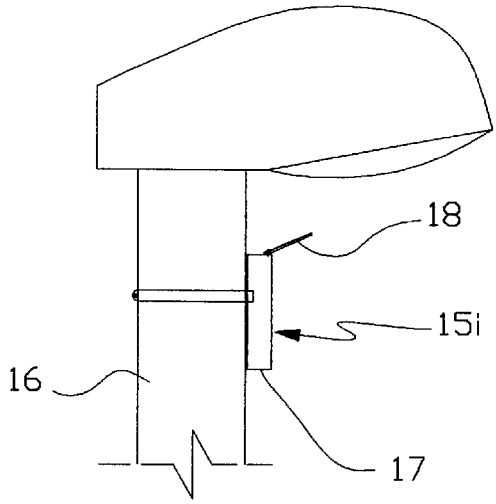
FIG. 3 is a schematic view of a lamp standard with which a device according to a variant of the invention is associated.
Figure 4:
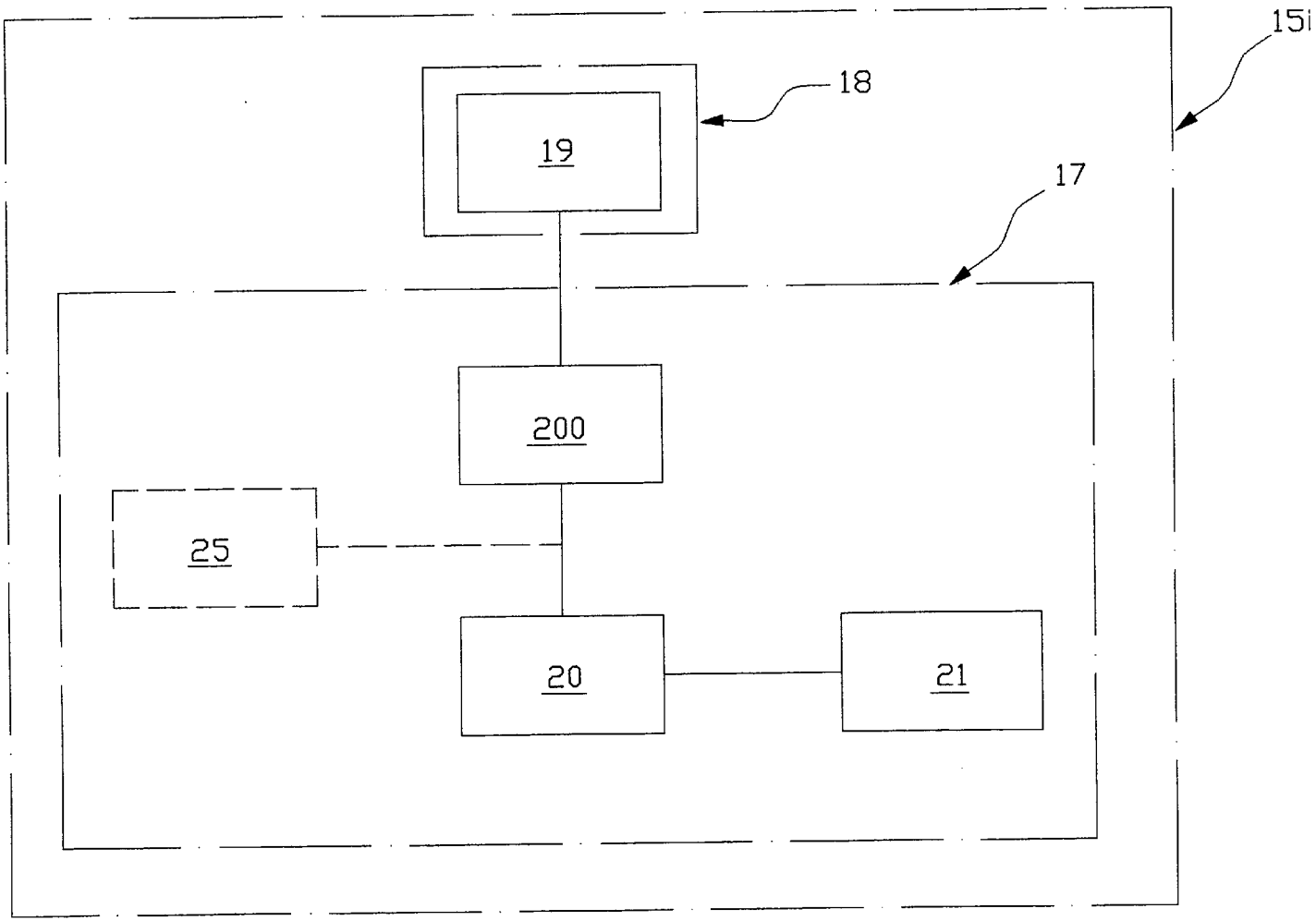
FIG. 4 is a circuit block diagram of the device of FIG. 3.

FIGS. 3 and 4 show a variant of the invention which is advantageous for its ease of installation and its simplicity.

This variant of the invention associates with each lamp $\mathbf{1}_i$ a sensing device $\mathbf{15}_i$, where i is a whole number which varies from 1 to n, n being the number of lamps present in the lighting network to which the invention is applied.

With reference to FIG. 3, it can be seen that each of the devices $\mathbf{15}_i$ is fixed to the lamp standard 16 below the lamp $\mathbf{2}_i$.

Each device comprises an outer casing 17, with which there is associated an orientatable panel, on the surface of which there is present at least one photovoltaic cell 19 which is positioned, by correctly orientating the panel 18, such as to intercept at least a portion of the luminous flux emitted by the lamp $\mathbf{2}_i$.

The photovoltaic cell (FIG. 4) powers a microprocessor 20 contained within the casing 17, via a suitable switching feeder 200. The microprocessor is connected to a transmitter/receiver 21 totally identical to the already described transmitter/receiver 7 and performing the same functions.

The photovoltaic cell 19 also performs the function of sensor for sensing whether the lamp is light-producing or extinguished, and the degree of efficiency of the lamp.

These data are made available to the microprocessor which when it has processed them feeds them to the transmitter/receiver 21 which transmits them to the operational control centre.

From the aforegoing it can be seen that this embodiment of the invention is easy and quick to install even on already existing lighting networks, as there is no need to make any electrical connection to the power supply line to the lamp $\mathbf{2}_i$.

In a further variant of the invention, said photovoltaic cell 19 powers a storage battery 25 which powers the electrical components of the device $\mathbf{15}_i$.

The operation of the invention is controlled by suitable software contained in a computer, not shown, housed in the operational control centre.

In practice, at regular time intervals each device $\mathbf{1}_i$ or $\mathbf{15}_i$ measures the characteristic operating parameters of the lamp, and transmits them at least to the upstream device $\mathbf{1}_{i-1}$, together with the data measured by the devices $\mathbf{1}_{i+1,n}$. The data are then transmitted in succession from one device to the preceding, until the operational control centre is reached.

Figure 5:
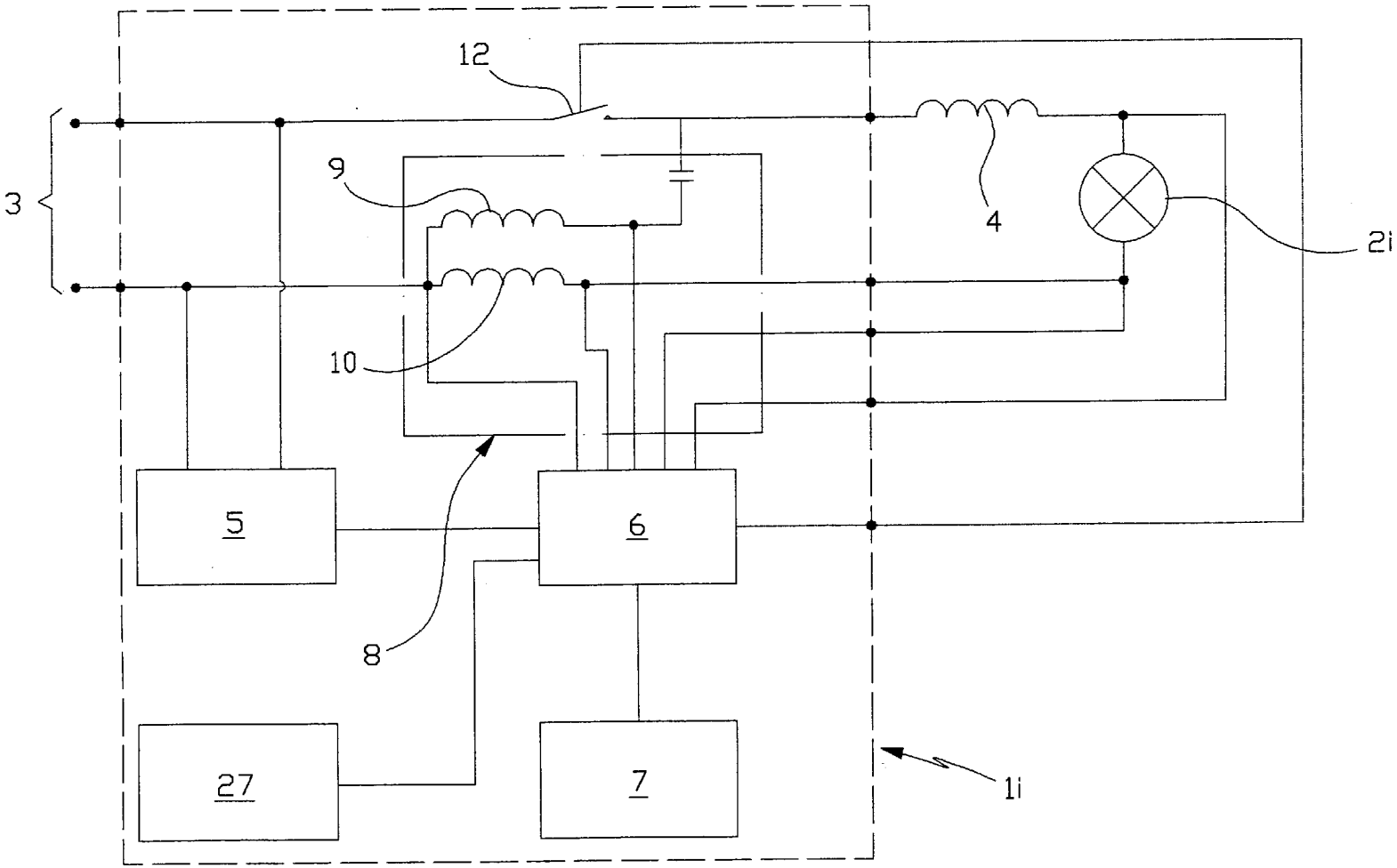
FIG. 5 is a block diagram showing a variant of the component devices of the system according to the invention.

If one of the devices is not functioning, the transmission of the data measured by the device $\mathbf{1}_{i+1}$ is received by the device $\mathbf{1}_{i-1}$ so that there is no interruption in the continuity of the monitoring system. FIG. 5 shows a variant of the devices $\mathbf{15}_i$ according to the invention. Said variant differs from that already described only by the presence, within each device $\mathbf{15}_i$, of a usual receiver 27 for a position satellite signal of GPS type. Said signal is made available to the microprocessor 6 which feeds it, together with the characteristics measured by the device, to the operational control or monitoring centre 100. All this offers the advantage of simpler identification of each lamp by the operator and when appropriate by the maintenance personnel.

What is claimed is:

1. A monitoring and management system for the lamps of a lighting network powered by an electric line providing line voltage, each lamp being connected in parallel to said line between at least one preceding lamp and/or at least one following lamp, the system comprising, associated with each lamp of the network, a device provided with means for measuring at least one of the characteristic operating parameters of the lamp selected from the group consisting of the voltage, the current and the power factor of the lamp, at least one microprocessor for processing said measured operating parameters, and a device for transmitting said measured operating parameters which are received by a central unit, wherein said device is a transmitter/receiver of radio wave type and is arranged to receive the measured operating parameters from other transmitter/receivers of the devices each associated to the respectively following lamps of the network and to transmit them, together with the parameters measured by the device for the lamp with which it is associated, to at least another transmitter/receiver of another device associated with the preceding lamp.

2. A system as claimed in claim 1, characterised in that each device is powered by a power unit connected to the line voltage.

3. A system as claimed in claim 1, characterised in that each device is powered by at least one photovoltaic cell.

4. A system as claimed in claim 3, characterised in that each device comprises a storage battery powered by said photovoltaic cell.

5. A system as claimed in claim 4, characterised in that a switching feeder is interposed between said photovoltaic cell and said battery.

6. A system as claimed in claim 1, characterised in that said means for measuring the characteristic operating parameters of the lamp comprise two units for measuring the line voltage, the lamp voltage, the lamp current and the power factor.

7. A system as claimed in claim 1, characterised in that said measurement means comprise at least one photovoltaic cell.

8. A system as claimed in claim 5, characterised in that said photovoltaic cell also powers the electrical and electronic components of the device.

9. A system as claimed in claim 1, characterised in that a receiver for a position satellite signal of GPS type is associated with each lamp.

10. A system as claimed in claim 9, characterised in that said signal is made available to said microprocessor.

11. A system as claimed in claim 10, characterised by comprising a monitor for displaying the position of each lamp with reference to a map which illustrates at least that zone involving the lighting network.

* * * * *